United States Patent [19]

Carrozza

[11] Patent Number: 5,040,729

[45] Date of Patent: Aug. 20, 1991

[54] SPRINKLER SYSTEM

[76] Inventor: Mark J. Carrozza, 15391 Turquoise Cir. N., Chino, Calif. 91709

[21] Appl. No.: 480,713

[22] Filed: Feb. 15, 1990

[51] Int. Cl.[5] ..... B05B 15/08

[52] U.S. Cl. ..... 239/201; 239/207; 239/269; 285/168; 285/276; 285/921

[58] Field of Search ..... 239/200, 201, 203, 204, 239/205, 207, 269; 285/168, 181, 281, 276, 921, 179

[56] References Cited

U.S. PATENT DOCUMENTS

| | | | |
|---|---|---|---|
| 471,247 | 3/1892 | Vanderman | 285/179 X |
| 1,337,744 | 4/1920 | Ballerstedt | 239/203 |
| 1,710,888 | 4/1929 | Munz | 239/204 |
| 2,879,083 | 3/1959 | Corsette | 285/168 X |
| 2,907,590 | 10/1959 | Oswald | 285/281 X |
| 3,684,179 | 8/1972 | Fischer et al. | 239/203 |
| 3,784,233 | 1/1974 | Hilberg | 285/179 X |
| 3,900,221 | 8/1975 | Fouts | 285/168 X |
| 4,037,861 | 7/1977 | Medney | 285/181 X |
| 4,214,779 | 7/1980 | Losell | 285/921 X |
| 4,451,069 | 5/1984 | Melone | 285/921 X |
| 4,783,100 | 11/1988 | Klein | 285/276 |
| 4,844,512 | 7/1989 | Gahwiler | 285/423 X |
| 4,946,024 | 8/1990 | Boticki | 285/281 |

FOREIGN PATENT DOCUMENTS

| | | | |
|---|---|---|---|
| 143461 | 8/1980 | Fed. Rep. of Germany | 285/181 |
| 455539 | 9/1950 | Italy | 285/181 |
| 163263 | 5/1958 | Sweden | 285/168 |

*Primary Examiner*—Andres Kashnikow
*Assistant Examiner*—William Grant

[57] ABSTRACT

A sprinkler system employs an articulated riser for adjustable sprinkler head positioning. The system allows for positioning each sprinkler head to compensate for ground irregularities by adjusting the position of the riser. The riser may be supplied for field use in assembled condition for direct fixed connection to T joints on the water main without excess ground digging. This substantially reduces part count for field use and system installation time. The joints of the riser provide leak-proof movable connections which allow for the position adjustments of the riser and connected head.

6 Claims, 2 Drawing Sheets

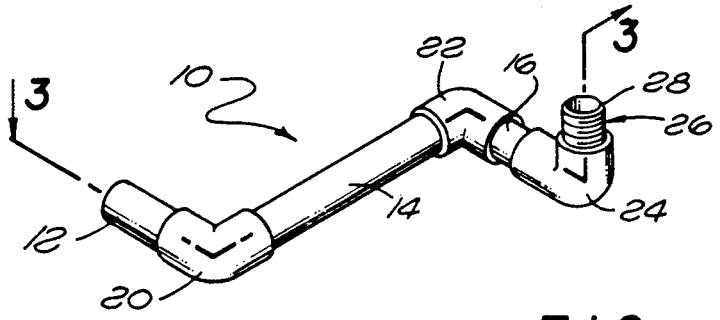
FIG. 1
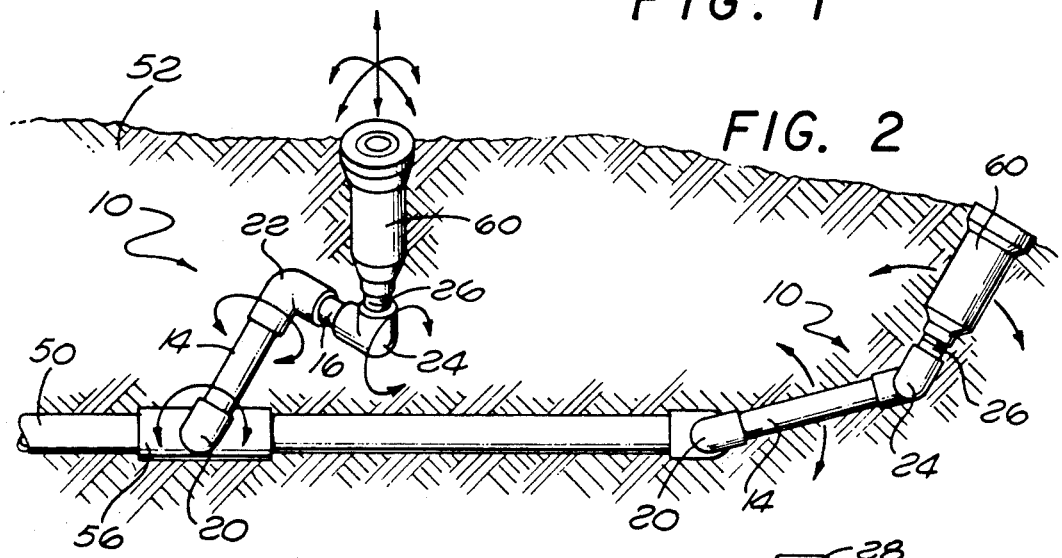
FIG. 2
FIG. 3A
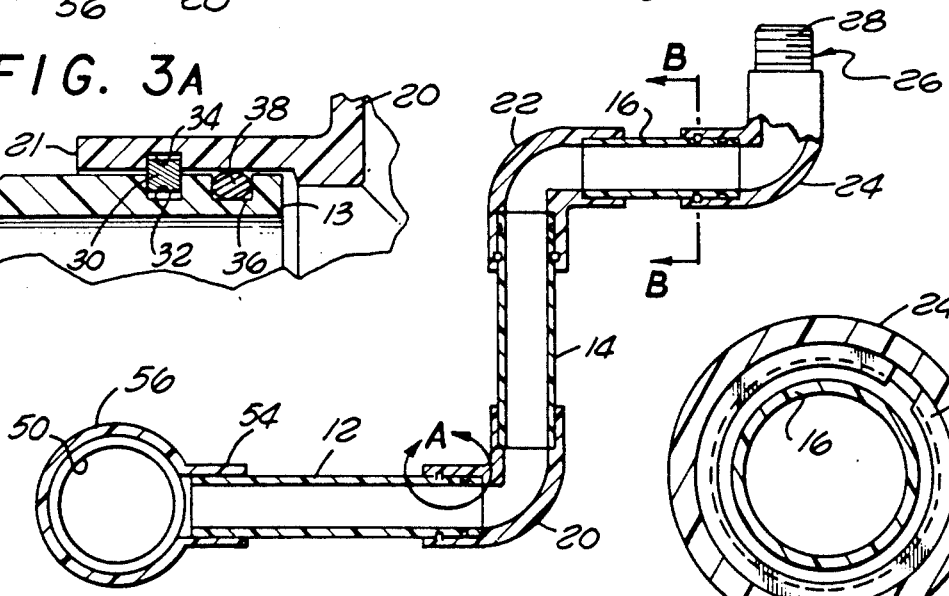
FIG. 3
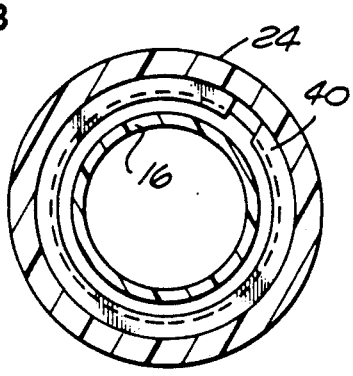
FIG. 3B

FIG. 4
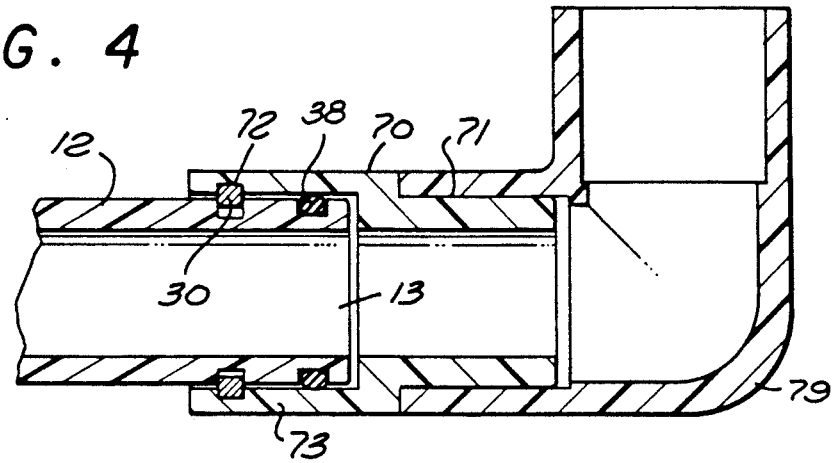
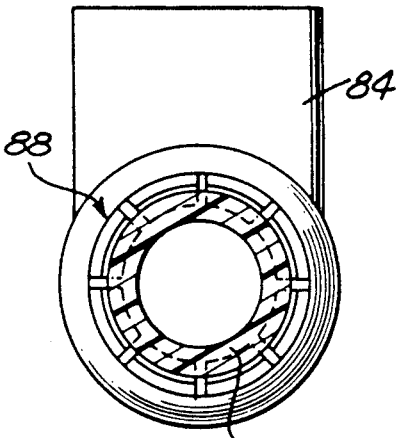
FIG. 6
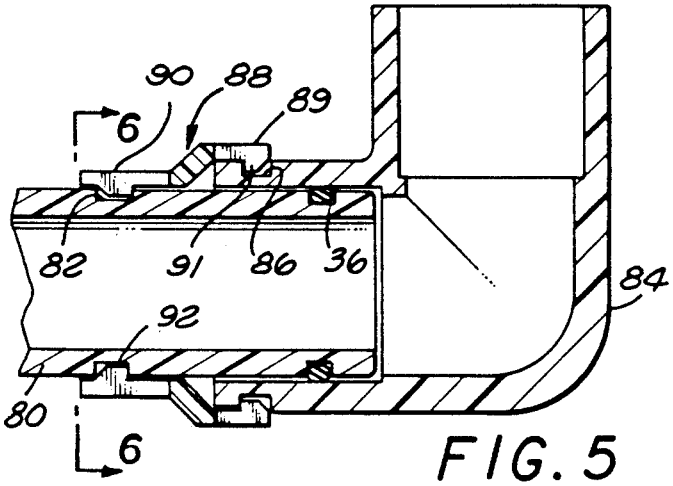
FIG. 5
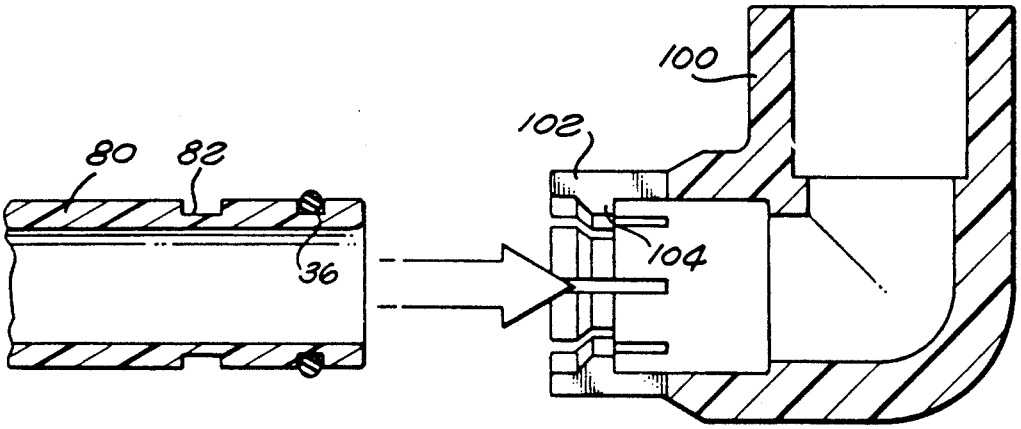
FIG. 7

SPRINKLER SYSTEM

FIELD OF THE INVENTION

This invention relates to a sprinkler system. More particularly, the invention relates to a sprinkler system which employs an infinite adjustment, leakproof, articulated riser which allows for easy and safe sprinkler head positioning to compensate for ground irregularities. The riser is preferably a single assembled unit when used in the field, which substantially reduces part count and system installation time.

BACKGROUND OF THE INVENTION

Irregularities in the ground surface and elevation present a problem when installing an underground irrigation system. It is normally desirable to have the sprinkler heads flush with the ground surface. However, with differences in the surface elevation and angle from the main, the risers must be customized to compensate. Solutions to this problem have not been satisfactory, typically causing a requirement for carrying extra parts in the field, increasing installation time, limiting reliability, and introducing leaks.

A common method of addressing the irregular ground problem is to use a semi-flexible riser with multiple threaded sections along its length. After ground preparation, each head that is not level with the ground (higher, lower, or bent) is dug out and the head removed, after which an extension or longer section is installed or the riser cut down as required. If the head is bent or out of alignment, a rock is jammed on the side of the riser to effect the desired orientation (risking damage to the riser). This procedure is time consuming, inaccurate, unreliable, and allows for contaminants (dirt) to be introduced into the system.

Another common method is illustrated in U.S. Pat. No. 1,337,744 to Ballerstedt. This patent discloses an adjustable riser which in one embodiment has a U shaped pipe having ends which are threaded into a T joint and an elbow respectfully or in a second embodiment has three elbows threaded on both ends and a pipe also threaded on both ends. In the second embodiment, one elbow is threaded onto a T of the main and to the pipe at the other end. The other two elbows are threaded together with one threaded to the other end of the pipe. This latter arrangement allows for the universal head adjustment as with the present invention. However, this system, due to its need for assembly after connection to a T of the main, increases part count and assembly time in the field. The joints involved are also not leakproof due to the need to leave them loose enough to allow for rotation into the desired position (or by virtue of such positioning).

SUMMARY OF THE INVENTION

It is, therefore, an object of the present invention, to provide a sprinkler system that compensates for ground irregularities in positioning of sprinkler heads which may be rapidly and reliably installed.

It is another object of the present invention to provide an infinite adjustment, leakproof articulated riser.

It is yet another object of the present invention to provide a sprinkler system that compensates for ground irregularities in positioning of sprinkler heads which employs a multi-adjustment, leakproof, articulated riser which is fully assembled prior to connection to the main such that field part count and installation time are reduced.

Briefly, in accordance with the invention there is provided an adjustable sprinkler system riser that comprises three pipes, three elbows, three connecting means, and three seal means. A first elbow is movably connected and sealed to one pipe and fixedly joined at the other end to a second pipe. A second elbow is movably connected and sealed to the second pipe and fixedly joined at the other end to a third pipe. A third elbow is movably connected and sealed to the third pipe. Various embodiments of the connecting means for providing the movable connection of elbow to pipe which allows for free swivel movement of the elbow to the movably connected pipe are disclosed.

In another embodiment of the invention, the riser set forth above is part of a sprinkler system. The riser is connected to a T of the water main at the free end of the first pipe and to nipple and sprinkler head at the free end of the third elbow.

Other objects and advantages of the invention will become apparent upon reading the following detailed description and upon reference to the drawings.

BRIEF DESCRIPTION OF THE DRAWINGS

FIG. 1 is a perspective view of an adjustable riser according to the present invention;

FIG. 2 is an fragmentary elevational view of a sprinkler system according to the present invention installed in the ground which employs two of the adjustable risers of FIG. 1;

FIG. 3 is an sectional view of the riser of FIG. 1 shown connected to a main taken in the direction of arrows 3—3;

FIG. 3A is a detail view of the connection and seal of the elbow and pipe designated at A in FIG. 3;

FIG. 3B is an enlarged sectional view taken in the direction of arrows B—B of FIG. 3;

FIG. 4 is a sectional view of another embodiment of elbow—pipe connection showing the use of an adaptor;

FIG. 5 is a sectional view of yet another embodiment of elbow—pipe connection showing the use of a coupler;

FIG. 6 is a sectional view of the elbow—pipe connection of FIG. 5 in the direction of arrows 6—6; and FIG. 7 is an exploded sectional view still another embodiment of elbow—pipe connection showing the use of a plurality of circumferential fingers integral to the elbow for connection to the pipe.

While the invention will be described in connection with the preferred embodiments, it will be understood that it is not intended to limit the invention to those embodiments. On the contrary, it is intended to cover all alternatives, modifications, and equivalents which may be included within the spirit and scope of the invention as defined by the appended claims.

DETAILED DESCRIPTION OF THE INVENTION

Referring now to FIG. 1, there is shown an articulated adjustable riser generally designated at 10 in accordance with the present invention. The riser includes a first pipe 12, second pipe 14, and a third pipe 1B. An elbow 20 connects pipes 12 and 14. A second elbow 22 connects pipes 14 and 16. A third elbow 24 is connected at one end to the other end of pipe 16. Normally, a nipple 26 threaded at one end 28 is fixedly joined to the other end of elbow 24 by suitable means such as glue.

FIGS. 3, 3A, and 3B illustrate the preferred connection and sealing of the elbows and pipes. Elbow 20 is fixedly joined to pipe 14 by suitable means such as glue. Similarly, elbow 22 is fixedly joined to pipe 16. Elbow 20 is movably connected to pipe 12 such that elbow 20 (and the rest of the riser past elbow 20) is free to swivel relative to pipe 12. This is accomplished with the use of a split ring 30 which is positioned between a circumferential groove 82 on pipe 12 near end 13 and an inner circumferential groove 34 near end 21 of elbow 20. In another circumferential groove 36 is positioned an O-ring 38 which bears against the inner surface of elbow 20 and seals the connection of elbow 20 to pipe 12. Groove 36 is positioned proximate to groove 32 between groove 32 and end 13 of pipe 12 (groove 36 could be positioned on the other side of groove 32 if desired, such that groove 32 would be closer to end 13, but this is not preferred). Elbow 22 is similarly connected and sealed to pipe 14 as is elbow 24 to pipe 16. See FIG. 3B which shows in a different detail view the swivel connection of pipe 16 to elbow 24 with the use of a split ring 40. Thus, elbow 20 may swivel relative to pipe 12, and likewise elbow 22 to pipe 14 and elbow 24 to pipe 16.

Referring additionally to FIG. 2, there is shown a sprinkler system according to the present invention which uses two of the adjustable risers 10. A water main 50 is buried in the ground 52. Risers 10 are fixedly (preferably by glue) connected to the stem 54 of a I joint 56 in main 50. A sprinkler head 60 is connected to nipple 26. The head 60 may then be positioned to conform with the ground surface. The riser 10 allows movement up and down, right and left, and forward and back by virtue of the swivel connections of elbows 20, 22, and 24 to pipes 12, 14, and 16 respectively. It should now be understood that the adjustable riser 10 can be used in the field as a single part (fully assembled) and need only be joined to a T of the main (and to the sprinkler head if not already connected) without any excess digging and simply moved into the desired position relative to the ground to complete installation. This minimizes installation time and necessary parts for field use, while avoiding introducing contaminants or leaks into the system.

FIG. 4 illustrates another embodiment for the seal and swivel connection of an elbow to pipe of the riser 10. Elbow 79 (which is a slight variation of elbow 20) and pipe 12 are shown, although it could be any or all of such swivel connections. The only essential difference from the embodiment of FIGS. 1–3 is the use of adaptor 70. Cylindrical adaptor 70 has a portion 71 which fits within the bore of elbow 79 land is preferably glued thereto) and relatively larger portion 73 fitted around the end 13 of pipe 12. In this embodiment the elbow 79 does not have an inner circumferential groove. This is in the adaptor 70 at 72. Thus, portion 73 is movably connected to pipe 12. This translates directly to elbow 79 by virtue of the fixed connection to portion 71. The O-ring seal 38 is made between pipe 12 and portion 73. As such, adaptor 70 constitutes an extension of elbow 79. It can also be used if it is desired that elbow 20 not have an inner circumferential groove or to accommodate a differing inner diameter of elbow 20 and outer diameter of pipe 12.

FIGS. 5 and 6 illustrate another embodiment which allows for joint disassembly. Again, any or all of the swivel connections could be such. Pipe 80 is a slight variation of pipe 12. The only difference is a circumferential groove 82 which has a greater spacing from the seal groove 36. Elbow 84 is also a slight variation of elbow 20. Here the circumferential groove 86 is on the outer surface of the elbow. This embodiment also employs a cylindrical coupler 88 which makes the swivel connection of elbow 84 to pipe 80. Coupler 88 has a resilient large diameter portion 89 which has an inwardly extending flange 91 which fits within groove 86. Coupler 88 also has a resilient small diameter portion 90 having an inwardly extending flange 92 which fits within groove 82. Coupler 88, by virtue of its external connections to pipe 80 and elbow 84 allows for disassembly of the joint if desired, by lifting the flange 91 from groove 86 or the flange 92 from groove 82.

Another swivel connection/seal joint assembly is shown in FIG. 7. Here pipe 80 is used again, but the retainer is part of the elbow 100. Elbow 80 is preferably molded with a plurality of integral circumferentially aligned resilient fingers on the end of the elbow 80 to be movably connected. Fingers 102 each have an inwardly extending flange 104. Flanges 104 fit within groove B2 to connect pipe 80 to elbow 100 while allowing elbow 100 to swivel relative to pipe 80. This embodiment also allows for the disassembly of the joint if desired, by lifting flanges 104 from groove 82.

Thus it is apparent that there has been provided in accordance with the invention, an adjustable riser and sprinkler system that fully satisfies the objectives, aims, and advantages set forth above. While the invention has been described in connection with specific embodiments thereof, it is evident that many alternatives, modifications, and variations will be apparent to those skilled in the art in light of the forgoing description. Accordingly, it is intended to embrace all such alternatives, modifications, and variations which will fall within the spirit of the appended claims.

What is claimed is:

1. An adjustable sprinkler system riser comprising:

first, second, and third pipes;

a first elbow fixedly joined to said second pipe;

first connecting means movably connecting said first elbow to said first pipe such that said first elbow is free to swivel relative to said first pipe;

first seal means sealing the connection of said first elbow to said first pipe, said first seal means comprising an O-ring positioned between said first pipe and said first elbow;

a second elbow fixedly joined to said third pipe;

second connecting means movably connecting said second elbow to said second pipe such that said second elbow is free to swivel relative to said second pipe;

second seal means sealing the connection of said second elbow to said second pipe, said second seal means comprising an O-ring positioned between said second pipe and said second elbow;

a third elbow;

third connecting means movably connecting said third elbow to said third pipe such that said third elbow is free to swivel relative to said third pipe;

third seal means sealing the connection of said third elbow to said third pipe, said third seal means comprising an O-ring positioned between said third pipe and said third elbow; and wherein each of said pipes has a first circumferential groove in which is positioned the O-ring of the respective seal means, each of said connecting means comprises a split ring, a second circumferential groove in the respective pipe, and an inner circumferential groove in the bore of the respective elbow, said split ring being rectangular in cross section, each said inner and second circumferential grooves having the side walls thereof orthogonally disposed relative to the longitudinal axis of the respective pipe or elbow in which it is positioned, said split ring positioned between said second groove and said inner groove, and wherein said second groove of each of said connecting means is positioned proximate to the respective first groove.

2. The sprinkler system riser of claim 1 also including a nipple, said nipple joined at one end thereof to said third elbow at the end of said third elbow not connected to said third pipe.

3. The sprinkler system riser of claim 2 also including a sprinkler head, said sprinkler head connected to the other end of said nipple.

4. An adjustable sprinkler system riser comprising:

first, second, and third pipes;

a first elbow fixedly joined to said second pipe;

first connecting means movably connecting said first elbow to said first pipe such that said first elbow is free to swivel relative to said first pipe;

first seal means sealing the connection of said first elbow to said first pipe, said first seal means comprising an O-ring positioned between said first pipe and said first connecting means;

a second elbow fixedly joined to said third pipe;

second connecting means movably connecting said second elbow to said second pipe such that said second elbow is free to swivel relative to said second pipe;

second seal means sealing the connection of said second elbow to said second pipe, said second seal means comprising an O-ring positioned between said second pipe and said second elbow connecting means;

a third elbow;

third connecting means movably connecting said third elbow to said third pipe such that said third elbow is free to swivel relative to said third pipe;

third seal means sealing the connection of said third elbow to said third pipe, said third seal means comprising an O-ring positioned between said third pipe and said third elbow connecting means; and wherein each of said pipes has a first circumferential groove in which is positioned the O-ring of the respective seal means, and at least one of said connecting means includes a hollow cylindrical adaptor, said adaptor connecting the respective elbow and pipe, said adaptor having a first end fitting within said elbow and a second end fitting around the connected end of said respective pipe, said adaptor fixedly joined to said elbow and connected for swiveling movement to said pipe, said at least one connecting means also including a split ring, a second circumferential groove in said pipe, and an inner circumferential groove in the bore of said adaptor, said split ring being rectangular in cross section, said inner and second circumferential grooves having the side walls thereof orthogonally disposed relative to the longitudinal axis of the respective pipe or adaptor in which it is positioned, said split ring positioned between said second groove and said inner groove, said second groove being positioned proximate to the respective first groove.

5. An adjustable sprinkler system riser comprising:

first, second, and third pipes;

a first elbow fixedly joined to said second pipe;

first connecting means movably connecting said first elbow to said first pipe such that said first elbow is free to swivel relative to said first pipe;

first seal means sealing the connection of said first elbow to said first pipe, said first seal means comprising an O-ring positioned between said first pipe and said first elbow;

a second elbow fixedly joined to said third pipe;

second connecting means movably connecting said second elbow to said second pipe such that said second elbow is free to swivel relative to said second pipe;

second seal means sealing the connection of said second elbow to said second pipe, said second seal means comprising an O-ring positioned between said second pipe and said second elbow;

a third elbow;

third connecting means movably connecting said third elbow to said third pipe such that said third elbow is free to swivel relative to said third pipe;

third seal means sealing the connection of said third elbow to said third pipe, said third seal means comprising an O-ring positioned between said third pipe and said third elbow; and wherein each of said pipes has a first circumferential groove in which is positioned the O-ring of the respective seal means, and at least one of said connecting means includes a coupler, said coupler connecting the respective elbow and pipe, said coupler having a first end fitting around the end of said elbow to be movably connected and a second end fitting around the connected end of said respective pipe, said elbow having an outer circumferential groove on the outer surface of its end to be movably connected, said pipe having a second circumferential groove on the outer surface thereof, said coupler positioned with its first end connected to said outer circumferential groove and its second end connected to said second circumferential groove, said coupler allowing swiveling movement of said connected elbow relative to said pipe.

6. An adjustable sprinkler system riser comprising:

first, second, and third pipes;

a first elbow fixedly joined to said second pipe;

first connecting means movably connecting said first elbow to said first pipe such that said first elbow is free to swivel relative to said first pipe;

first seal means sealing the connection of said first elbow to said first pipe, said first seal means comprising an O-ring positioned between said first pipe and said first elbow;

a second elbow fixedly joined to said third pipe;

second connecting means movably connecting said second elbow to said second pipe such that said second elbow is free to swivel relative to said second pipe;

second seal means sealing the connection of said second elbow to said second pipe, said second seal means comprising an O-ring positioned between said second pipe and said second elbow;

a third elbow;

third connecting means movably connecting said third elbow to said third pipe such that said third elbow is free to swivel relative to said third pipe;

third seal means sealing the connection of said third elbow to said third pipe, said third seal means comprising an O-ring positioned between said third pipe and said third elbow; and wherein each of said pipes has a first circumferential groove in which is positioned the O-ring of the respective seal means, and at least one of said connecting means includes a second circumferential groove in the respective pipe and a plurality of circumferentially aligned fingers on the end of the elbow to be movably connected to said pipe, said second groove having the side walls thereof orthogonally disposed relative to the longitudinal axis of the respective pipe, said fingers each having a flange projecting radially inwardly, said flange having one side which is orthogonally disposed relative to the longitudinal axis of the elbow, said flanges of said flanges positioned within said second groove with said one side of said flanges positioned adjacent to the side of the respective second groove which is closest to said first groove in order to maintain the connection of said pipe and said elbow and to allow the connected elbow to swivel relative to said pipe.

* * * * *